US005210576A

United States Patent [19]

Haneda et al.

[11] Patent Number: 5,210,576

[45] Date of Patent: * May 11, 1993

[54] IMAGE FORMING APPARATUS HAVING A FIRST MODE FOR FORMING A MULTICOLOR IMAGE OF RESTRICTED LENGTH AND A SECOND MODE FOR FORMING A MONOCOLOR IMAGE OF UNRESTRICTED LENGTH

[75] Inventors: Satoshi Haneda; Masakazu Fukuchi; Shizuo Morita; Shunji Matsuo, all of Tokyo, Japan

[73] Assignee: Konica Corporation, Tokyo, Japan

[ * ] Notice: The portion of the term of this patent subsequent to Mar. 5, 2008 has been disclaimed.

[21] Appl. No.: 863,329

[22] Filed: Apr. 2, 1992

Related U.S. Application Data

[63] Continuation of Ser. No. 661,119, Feb. 27, 1991, abandoned, which is a continuation-in-part of Ser. No. 439,708, Nov. 20, 1989, Pat. No. 4,998,145.

[30] Foreign Application Priority Data

Mar. 2, 1990 [JP] Japan ..... 2-52430

[51] Int. Cl.[5] ..... G03G 15/14

[52] U.S. Cl. ..... 355/271; 355/274; 355/326

[58] Field of Search ..... 355/200, 210, 271, 272, 355/274, 326, 327

[56] References Cited

U.S. PATENT DOCUMENTS

| | | | |
|---|---|---|---|
| 3,883,242 | 5/1975 | Takahashi et al. | 355/210 |
| 4,072,412 | 2/1978 | Suda et al. | 355/274 |
| 4,586,810 | 5/1986 | Landa | 355/215 |
| 4,642,661 | 2/1987 | Dean, II | 346/153.1 |
| 4,674,860 | 6/1987 | Tokunaga et al. | 355/274 |
| 4,998,145 | 5/1991 | Haneda et al. | 355/327 |

FOREIGN PATENT DOCUMENTS

| | | |
|---|---|---|
| 60-76766 | 5/1985 | Japan . |
| 61-123257 | 6/1986 | Japan . |
| 0144565 | 6/1990 | Japan . |

*Primary Examiner*—A. T. Grimley
*Assistant Examiner*—J. E. Barlow, Jr.
*Attorney, Agent, or Firm*—Finnegan, Henderson, Farabow, Garrett & Dunner

[57] ABSTRACT

A color image forming apparatus having an image retainer, a transfer member and selection device for selecting one of a monochromatic mode for forming a monochromatic toner image on the transfer member and a multicolor mode for forming a multicolor toner image composed of a plurality of monochromatic toner images on the transfer member. The maximum length of the multicolor toner image is limited within a size corresponding to an effective peripheral length of the transfer member when the multicolor mode is selected.

6 Claims, 13 Drawing Sheets

IMAGE FORMING APPARATUS HAVING A FIRST MODE FOR FORMING A MULTICOLOR IMAGE OF RESTRICTED LENGTH AND A SECOND MODE FOR FORMING A MONOCOLOR IMAGE OF UNRESTRICTED LENGTH

This application is a continuation of application Ser. No. 07/661,119, filed Feb. 27, 1991, now abandoned, which was a continuation-in-part of application Ser. No. 07/439,708, filed Nov. 20, 1989, now issued as U.S. Pat. No. 4,998,145, patented Mar. 5, 1991.

BACKGROUND OF THE INVENTION

1. Field of the Invention

This invention relates to a color image forming apparatus using the electrophotography, and more particularly to a color image forming apparatus using an image retainer and a transfer member in which a copy mode can be changed to one of a multicolor mode and a monochromatic mode.

2. Description of the Prior Art

As a color image forming apparatus, an apparatus as disclosed in the official Gazette on Japanese Patent Laid-Open No. 76766/1985, for example, has been proposed. In such apparatus, a color toner image is formed on an image retainer by repeating writing of each color information by a laser beam scanner and developing with developers each including different color toner, transferred at a time electrostatically on a transfer material by using a corona discharger, and then fixed to form a color image. Such apparatus has a high precision of superposition of the different color toner images, because toner images different in color are superposed on the image forming member. However, it has a problem that a toner image formed previously affects on a toner image formed thereafter. Further, a good color image can not be obtained by the conventional analogue system.

Accordingly, the Official Gazetter on Japanese Patent Laid-Open No. 123257/1986 suggests such a technique that a rotary transfer drum is used and different color toner images are superposed on a transfer material wound around said rotary transfer drum. In this technique, a color toner image is formed on the transfer material by repeating a series of steps of writing on the image retainer with a laser beam modulated by a digital signal of separated color image informations, developing with a developer containing a color toner, and transferring a color toner image obtained by said developing on a transfer material wound around the transfer drum, and by fixing a color toner image thus obtained on the transfer material. Specifically, this technique is similar to the black and white image forming process wherein toner images are transferred on the transfer material whenever one toner image is formed on the image forming drum.

Further, there has been proposed an apparatus wherein color toner images different in color are superposed on a transfer drum by repeating said series of steps on the transfer drum, and the superposed different color toner images are transferred electrostatically at a time on a transfer material, and then fixed to form a color image.

It is necessary to use a transfer drum of which peripheral length is longer than the length of a recording paper on which the color image recording is carried out, even in a case that toner images are superposed on a transfer material wound around a transfer drum, or that toner images are superposed on the transfer drum, as mentioned above. Accordingly, a color image forming apparatus using an image forming member and a transfer member for obtaining a color image of a large size becomes large in size. On the other hand, it is required sometimes to obtain an image of monochromatic by said color image forming apparatus.

SUMMARY OF THE INVENTION

An object of the present invention is to provide a color image forming apparatus wherein an image recording of a limited size can be carried out in a multicolor image recording, and wherein an image recording of a size larger than said limited size can be carried out in a monochromataic image recording.

Said object can be attained by a color image forming apparatus comprising an image forming member, a transfer member, a plurality of developing devices and selection means for selecting one of a monochromatic mode for forming a monochromatic toner image on said transfer member and a multicolor mode for forming a multicolor toner image by superposing a plurality of color toner images different in color on the transfer member, characterized by control means for controlling to limit the size of said multicolor toner image within a size corresponding to an effective peripheral length of said transfer member when said multicolor mode is selected.

The above and other objects as well as advantageous feature of the invention will become apparent from the following description of the embodiments taken in conjunction with the accompanying drawings.

DESCRIPTION OF THE PREFERRED EMBODIMENTS

A color image forming apparatus of the present invention will now be described on the basis of embodiments thereof shown in the accompanying drawings.

Figure 1:
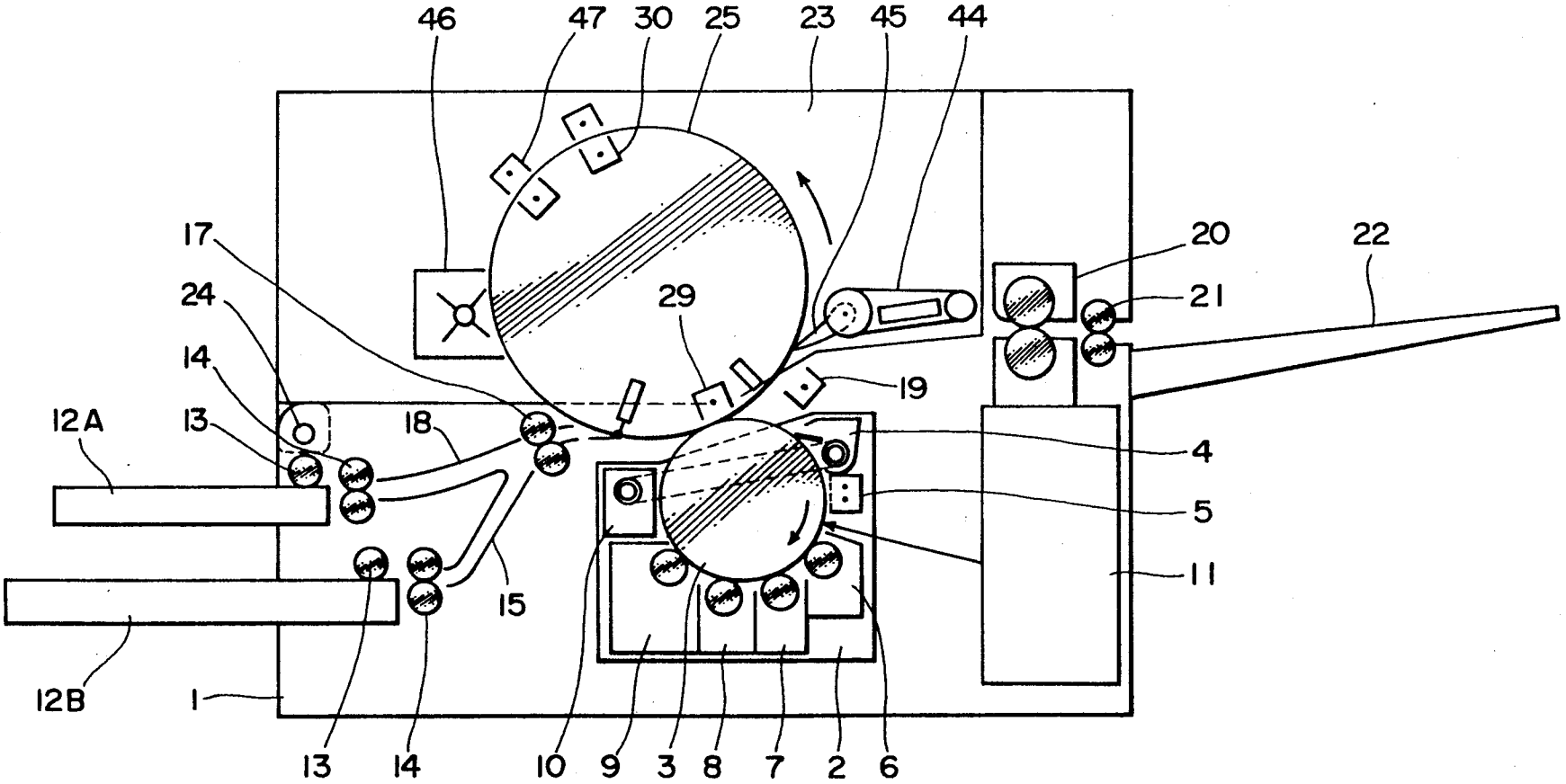
FIG. 1 is a schematic view of a color image forming apparatus of an embodiment according to the present invention.
Figure 2:
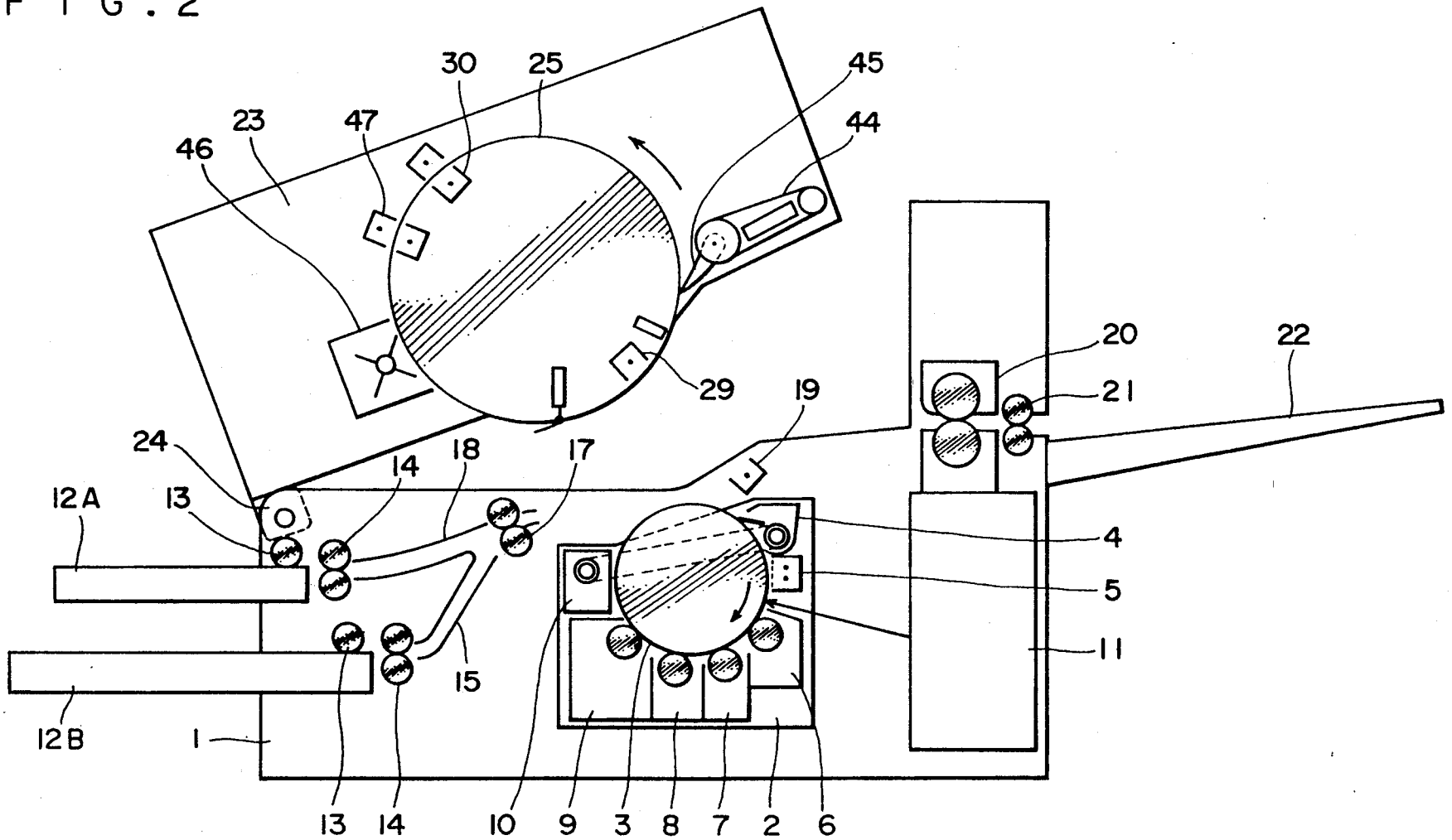
FIG. 2 is a schematic view of the color image forming apparatus shown in FIG. 1, with an upper case member being opened.
Figure 3:
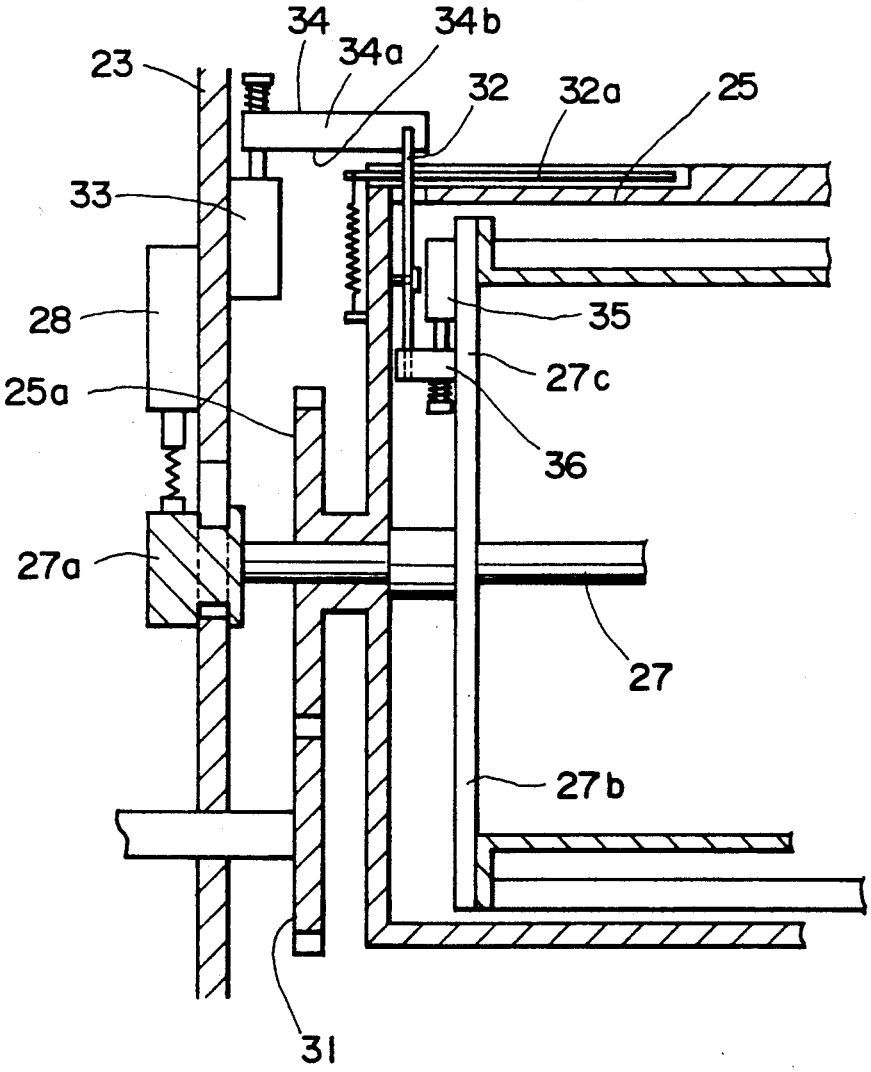
FIG. 3 is a sectional side view of the upper case member.
Figure 4:
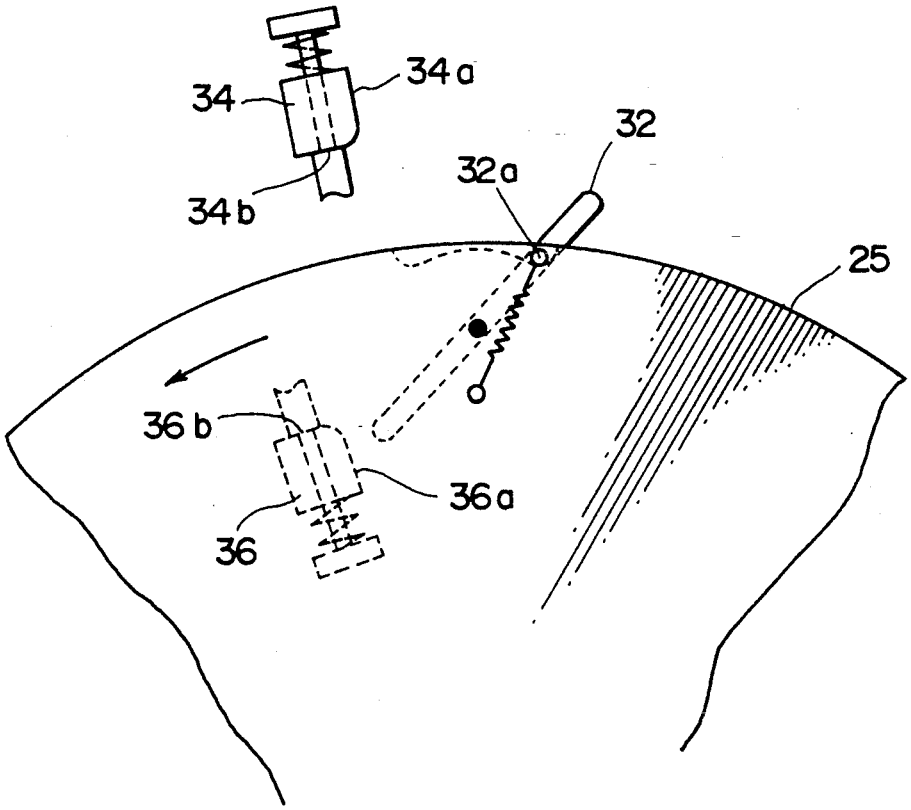
FIG. 4 is a view explaining means for holding the tip end of a recording paper on a transfer drum.

FIG. 1 is a schematic view of a color image forming apparatus of an embodiment according to the present invention; FIG. 2 is a schematic view of the color image forming apparatus shown in FIG. 1, with an upper case member being opened; FIG. 3 is a sectional side view of the upper case member; and FIG. 4 is a view explaining means for holding the tip end of a recording paper on a transfer drum.

Reference to these drawings, a reference numeral 1 denotes a lower case member, and 2 denotes a process cartridge including a photosensitive drum 3 as a drum-shaped image forming member. A cleaning device 4, a charging device 5, developing devices 6–9, and a toner reservoir 10 for receiving and storing a toner recovered by the cleaning device 4 are arranged around the periphery of said photosensitive drum 3, said developing devices 6–9 being positioned below the photosensitive drum 3. A transfer drum 25 as a drum-shaped transfer member is arranged so as to be brought into contact with the upper side of said photosensitive drum 3. Said process cartridge 2 is installed in said lower case member 1 so as to be withdrawable therefrom to the outside when the transfer drum 25 is separated from the photosensitive drum 3.

The lower case member 1 has further an image exposure device 11 consisting of a laser beam scanner; feed paper cassettes 12A and 12B; recording paper supply means consisting of feed rollers 13 for feeding recording papers sheet by sheet, pairs of forward rollers 14 for separating and forwarding the recording papers fed by the feed rollers 13, recording paper guides 15 and 18, and timing rollers 17 for feeding the recording papers synchronizing with the movement of the toner image; a separation device 19 for separating from the transfer drum 25 the recording paper on which a toner image has been transferred from the photosensitive drum 3; a fixing device 20 for fixing the toner image on the recording paper; a pair of exhaust rollers 21 for exhausting the fixed recording paper to the outside of the color image forming apparatus; and a tray 22 for receiving the recording paper.

A reference numeral 23 denotes an upper case member which connected at one end thereof through a hinge portion 24 to the lower case member 1 openably as shown in FIG. 2. The transfer drum 25 is small in size and light in weight, so that the stability and operability are superior even if the upper case member 23 is opened. As shown in FIG. 3, the transfer drum 25 is supported rotatably by the upper case member 23 through a supporting shaft 27. A block portion 27*a* formed at one end of said supporting shaft 27 is engaged through an elongated groove slidably with said upper case member 23 and connected through a spring to a transfer member moving device 28 such as an electromotive plunger etc. Said supporting shaft 27 has supporting arms 27*b* and 27*c* to which a transfer device 29 and a charging device 30 for attracting the recording paper are mounted, respectively. Accordingly, if the transfer member moving device 28 is driven in the state that the upper case member 23 is closed with respect to the lower case member 1 as shown in FIG. 1, the transfer drum 25 can be attached with or detached from the peripheral surface of the photosensitive drum 3. In such cases, the relative position of the transfer drum 25 to the transfer device 29 and the charging device 30 is not changed.

The transfer drum 25 is rotated by a drive gear 31 which is meshed with a gear 25*a* formed unitarily on the transfer drum 25. The drive gear 31 is arranged at a position remote from the center of rotation of the transfer drum 25 in a direction normal to the moving direction of the transfer drum 25 so that the movement of the transfer drum 25 does not affect substantially on the meshing of the drive gear 31 with the gear 25*a*.

The transfer drum 25 has at the back surface thereof holding means for holding the leading end of the recording paper so that the recording paper can be wound at a fixed position around the transfer drum 25. In the holding means, as shown in FIGS. 3 and 4, when a clamp lever 32 having a clamp bar 32*a* is positioned as shown in FIG. 4 the leading end of the recording paper is held between the clamp bar 32*a* and a groove formed on the peripheral surface of the transfer drum 25. When the clamp lever 32 is rotated in the counter-clockwise direction in FIG. 4, the recording paper is released from the holding means. The state of the clamp lever 32 shown in FIG. 4 can be obtained by moving an operation arm 34 to a position where it is brought into engagement with the tip end of the clamp lever 32 by an operation arm moving device 33 such as an electromotive plunger provided on the upper case member 23 as shown in FIG. 3, while rotating the transfer drum 25 in a direction of an arrow in FIG. 4.

Specifically, when the clamp lever 32 is moved from the position shown in FIG. 4 according to the rotation of the transfer drum 25 in the counter-clockwise direction the tip end of the clamp lever 32 is brought into engagement with an operation surface 34*a* of the operation arm 34, so that the clamp lever 32 is rotated in the clockwise direction while rotating the transfer drum 25 and fallen down to the position shown in FIG. 4.

After the clamp lever 32 has been rotated and positioned as shown in FIG. 4, a force receiving surface 34*b* of the operation arm 34 is urged by the tip end of the clamp lever 32 and retracted against a force of spring. Further, the clamp lever 32 can be rotated in the counter-clockwise direction and fallen down to a position opposite to the position shown in FIG. 4 by moving an operation arm 36 by an operation arm moving device 35 such as electromotive plunger mounted on the supporting arm 27*c* of the supporting shaft 27 shown in FIG. 3 to a position where the operation arm 36 is brought into engagement with the rear end of the clamp lever 32. That is, when the transfer drum 25 is rotated in the direction of the arrow shown in FIG. 4 the rear end of the clamp lever 32 is urged by an operation surface 36*a* of the operation arm 36, so that the clamp lever 32 is rotated in the counter-clockwise direction and fallen down to the position opposite to the position shown in FIG. 4. Thereafter, a force receiving surface 36*b* of the operation arm 36 is pushed by the rear end of the clamp lever 32 with the rotation of the transfer drum 25, and retracted against a force of spring.

In the holding means for the recording paper, said operation arm 36 and the operation arm moving device 35 thereof may be provided on the transfer drum 25.

The upper case member 23 has further a suction conveyer 44 for forwarding the recording paper from the transfer drum 25 and the fixing device 20, and according to the necessity a recording paper separation pawl 45, a transfer member cleaning device 46, and a charging device before cleaning 47 etc. The recording paper separation pawl 45 is brought into engagement with the peripheral surface of the transfer drum 25 only when the recording paper is to be separated therefrom. The transfer member cleaning device 46 is brought into contact with the surface portion of the transfer drum 25 on which no recording paper is positioned to remove a toner attached thereon. The charging device before cleaning 47 is used not only for eliminating charges on the transfer drum 25 in order to improve the toner removing efficiency, but also for charging the back surface of the transfer drum 25 in order to make sure the winding of the recording paper.

In the embodiment according to the present invention, the photosensitive drum 3 is a half in diameter of the transfer drum 25 of 100 mm, and the peripheral speeds of the photosensitive drum 3 and the transfer drum 25 at the image forming process are the same with each other. According to this embodiment, the process cartridge 2 can be made compact with reduced cost, because the precision of the positioning thereof can be improved and each of parts in the process cartridge 2 can be made small in size and light in weight.

In a stand-by state of the color image forming apparatus of the present invention, the transfer drum 25 is separated from the photosensitive drum 3, but the upper case member 23 is closed as shown in FIG. 1. When a start button is pressed to generate a copy start signal, following color image forming and recording operations are carried out.

Figure 7:
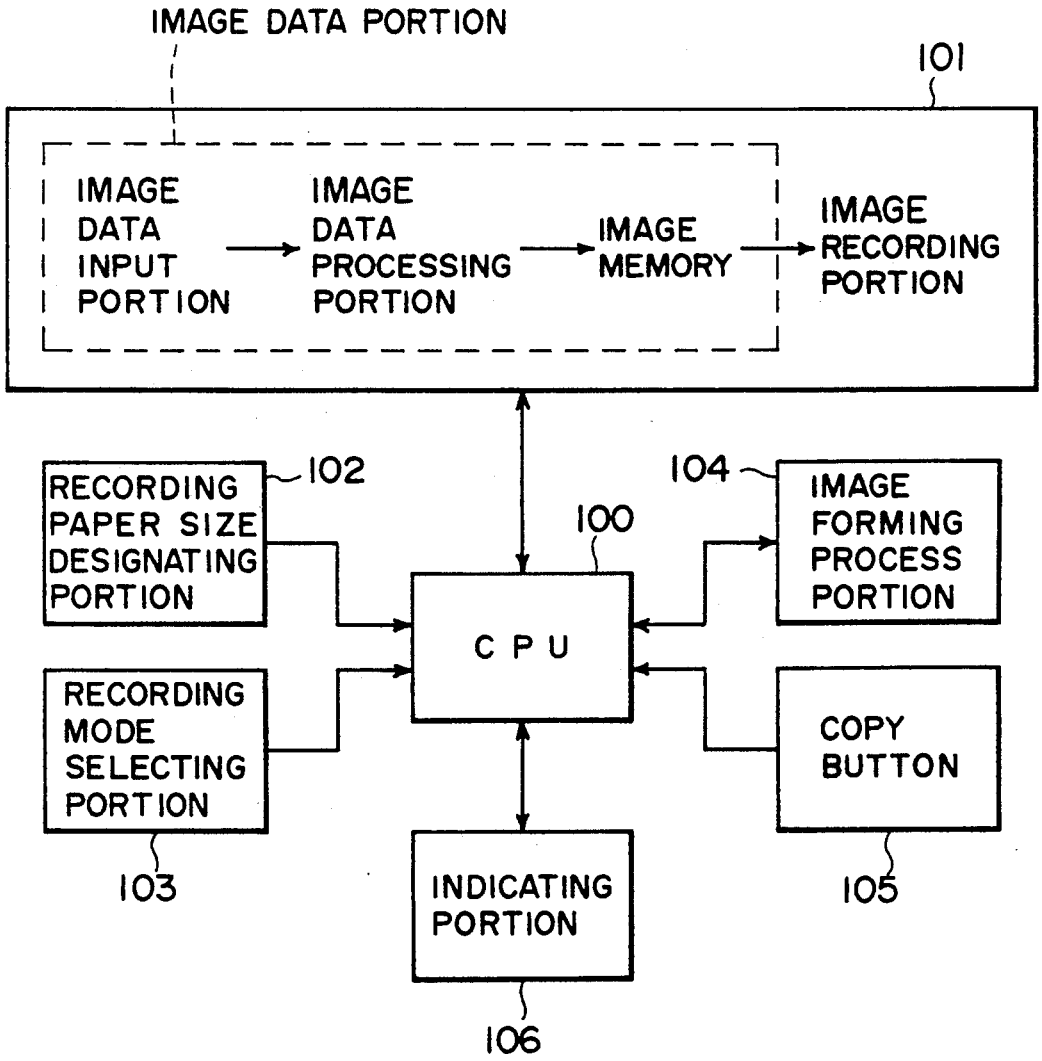
FIG. 7 is a block diagram of a control circuit of the apparatus shown in FIG. 1.

FIG. 7 is a block diagram showing a control circuit in said embodiment, wherein a reference numeral 100 denotes a CPU in the color image forming apparatus, and 101 is an image recording portion. In this image recording portion 101, an image data fed from an image data input portion is processed in an image data processing portion having a computer and memorized in an image memory, and an image exposure is carried out on the basis of the image data taken out of said image memory by the control of the CPU 100 to form an image on a recording paper as explained later.

Reference numeral 102 denotes a recording paper size designating portion provided on an operation panel for designating a size of the recording paper, 103 is a mode selecting portion provided on said operation panel for selecting one of a color mode for forming a multicolor developed image and a monochromatic mode for forming a monochromatic developed image, 104 is an image forming process portion for applying a program of an image forming process adapted to said recording paper size and the image forming mode according to a command from the CPU 100, 105 is a copy button provided on said operation panel for feeding the copy start signal when it is pressed, and 106 is an indicating portion arranged near said operation panel for indicating the image forming mode, recording paper size and copy inhibition state etc.

Figure 13:
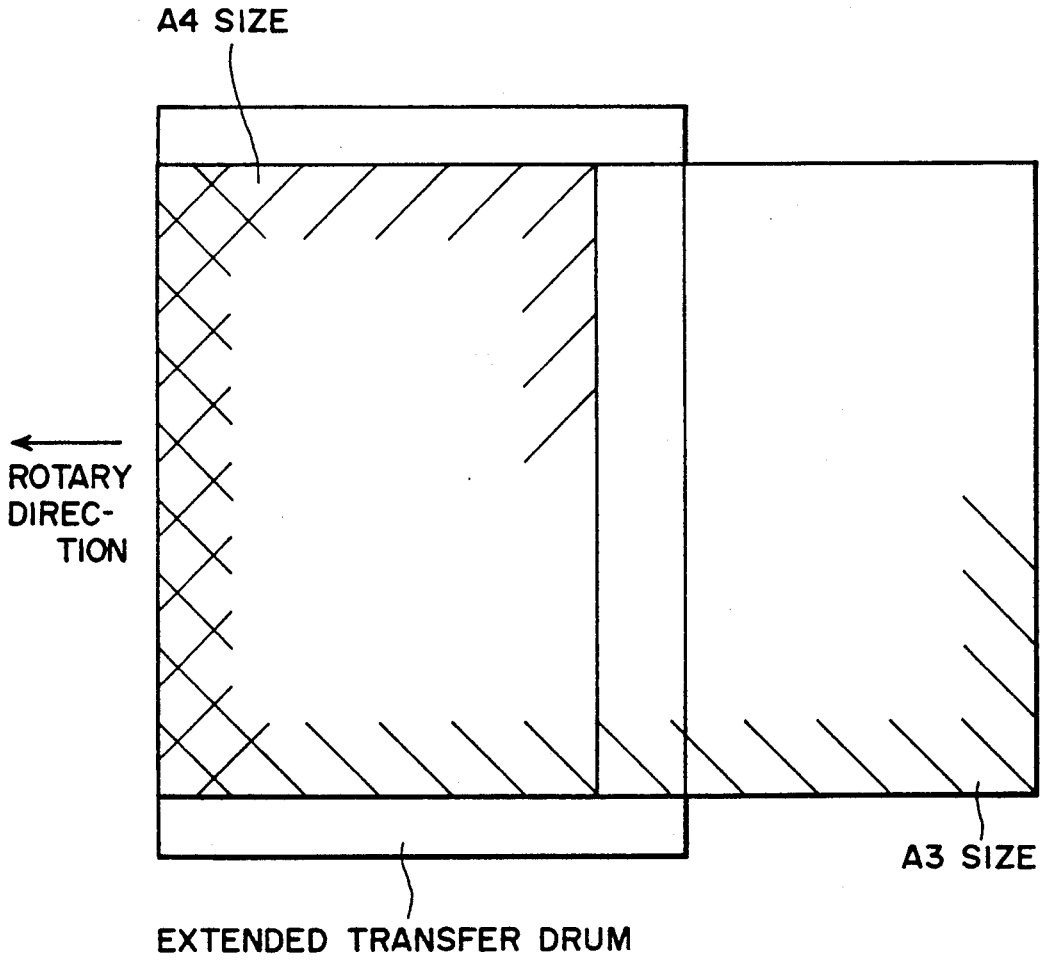
FIG. 13 is a view showing the relation between the peripheral surface of a transfer drum and the size of a recording paper.

In case that said color image forming apparatus having the transfer member of 100 mm in diameter is used, for example, if the maximum recording paper size in the color mode is 210 mm width as A4 size and fed transversely, the maximum recording paper size can be set as A3 size in the monochromatic mode as shown in FIG. 13, if the recording paper is fed in the longitudinal direction without being wound around the transfer member. In the color mode, A4 size is the maximum recording paper size as mentioned above and accordingly if A3 is designated erroneously the indicating portion 106 indicates a copy inhibition (or impossible) state, so that a copy start signal which is generated when the copy button is pressed is refused to be received by the CPU 100 according to an inhibition program stored in the CPU 100. Thus, the size of the developed color image is limited within the peripheral length of the transfer drum 25.

In a state of outside of said inhibition condition, that is, in case that A4 size is designated by the recording paper size designating portion 102 and the color mode button is pressed in the recording mode selecting portion 103, for example, CPU 100 is operated so that the indicating portion 106 indicates the color mode and the recording paper size of A4. When the CPU 100 to which the copy start signal generated by the pressed copy button 105 has been applied receives a control program adapted to said mode from the image forming process portion, the image forming process of the image recording portion 101 is carried out.

Specifically, in FIG. 1, when the copy button 105 is pressed the photosensitive member 3 is rotated in the direction of arrow, and the surface of the photosensitive member 3 is cleaned by the cleaning device 4 having a rubber blade etc., and charged uniformly by the charging device 5.

When the feed paper cassette 12A is selected by the designation of the recording paper size the recording papers are fed sheet by sheet by the feed rollers 13 and forwarded by the forward rollers 14 from the feed paper cassette 12A. When the leading end of the recording paper is detected by the detection means, the rotations of the feed rollers 13 and the forward rollers 14 are stopped. The image exposure is carried out for the color separated yellow (Y) image, for example, by the image exposure device 11, so that an electrostatic latent image of dot structure is formed.

The electrostatic latent image is subjected to the reversal developing to form the yellow (Y) toner image by the developing device 6, wherein the yellow (Y) toner is flown from a developing roller which is separated from the photosensitive drum 3. The recording paper is fed by the timing rollers 17 so that the leading end of the recording paper reaches a transfer portion having the transfer device 29 after the leading end of said Y toner image has passed through the other developing devices 7–9 of inoperative state but before it reaches the transfer portion. When the leading end of the recording paper reaches a position as shown in FIGS. 3 and 4 where the leading end of the recording paper can be held by the clamp bar **32*a*, it is detected and the transfer drum 25 is started to rotate in the direction of arrow. Then, the leading end of the recording paper is held by the clamp bar 32*a* driven by the operation arm 36 and at the same time the transfer drum 25 is brought into contact with the photosensitive drum 3 by the transfer member moving device 28. Thus, when the leading end of the Y toner image reaches the transfer portion the recording paper is brought into contact with the photosensitive drum 3 and moved at a constant speed. Before moving the recording paper, the recording paper is charged with a polarity opposite to a polarity of toner by the transfer device 29, so that the Y toner image on the photosensitive drum 3** is transferred to the recording paper.

In a modification, the leading end of the recording paper which has been fed from the feed paper cassette 12A is held on the stopped transfer drum 25 by recording paper holding means of the other type and then the transfer drum 25 is rotated at a timing at which the Y toner image on the photosensitive drum 3 reaches the recording paper. In this modification, a sufficient time for holding the leading end of the recording paper can be obtained.

The recording paper on which the Y toner image has been transferred is passed through the charging device 30 of operative state for attracting the toner image, the recording paper separation pawl 45, the charging device before cleaning 47, and the transfer member cleaning device 46 of inoperative state etc., in the state that the recording paper is wound around the transfer drum 25.

The surface of the photosensitive drum 3 from which the Y toner image has been transferred is cleaned by the cleaning device 4 of operative state. Then, the cleaned surface of the photosensitive drum 3 is charged uniformly by the charging device 5 at the third and fourth rotations of the photosensitive drum 3. An image exposure of color separated magenta (M) image, for example, is carried out by the image exposure device 11 on said surface charged uniformly to form an electrostatic latent image of dot structure at such a timing that the leading end of the electrostatic latent image formed by said image exposure is reached to the transfer portion. The electrostatic latent image is subjected to the reversal development by the developing device 7, for example, as like as by the developing device 6. The M toner image thus obtained is transferred by the action of the transfer device 29 to the recording paper on the transfer drum 25 at the second rotation of the transfer drum 25 to form on the recording paper a two-color image by superposing the M toner image on the Y toner image.

The transfer drum 25 is rotated continuously three times. At the fifth and sixth rotations of the photosensitive drum 3, cyan (C) toner image is formed, and at the seventh and eighth rotations of the photosensitive drum 3, black (BK) toner image is formed. These toner images thus formed are transferred to the recording paper on the transfer drum 25 at the third and fourth rotations of the transfer drum 25, respectively, so that a four-color image is formed on the recording paper by superposing the Y, M, C and BK toner images. The leading end of the recording paper on which the color image has been formed is released from the clamp bar 32*a* on the transfer drum 25 by the action of the operation arm 34 just before the leading end of the recording paper is reached to the separation device 19. Then, the recording paper is subjected to the AC discharge or a discharge of a polarity opposite to that of the transfer device 29 by the separation device 19, and the recording paper separation pawl 45 is operated, so that the recording paper is fed to the fixing device 20 while the back surface of the recording paper is attracted by the suction conveyer 44. Accordingly, the four-color image is formed and fixed by the fixing device 20 on the recording paper. The recording paper passed through the fixing device 20 is discharged to the paper receiving tray 22 by the pair of exhaust rollers 21.

The transfer drum 25 is separated from the photosensitive drum 3 by the transfer member moving device 28 after the trailing end of the recording paper has passed through the transfer portion, and stopped when the clamp bar 32*a* reaches the start position thereof. The photosensitive drum 3 is also stopped after the transfer drum 25 has been separated therefrom. A following color image formation may be carried out by repeating the above steps.

According to the above color image forming steps, the toner image forming surface of the photosensitive drum 3 does not contact with the surface of the transfer drum 25, so that the transfer member cleaning device 46 or the charging device before cleaning 47 can be used only when the stain at the back surface of the recording paper becomes conspicuous, or can be omitted. In case that the transfer member cleaning device 46 or the like is used, the transfer drum 25 must be rotated at least one time excessively than that in the case that the transfer member cleaning device 46 or the like is not used. The charging device before cleaning 47 may be used to bring the trailing end portion of the recording paper into intimate contact with the surface of the transfer drum 25, however, it may hardly be necessary to use when the charging device 30 for attracting the recording paper is provided. The charging device 30 is used for discharging as like as the transfer device 29 and operated between a time at which the transfer drum 25 is started to rotate and a time at which the recording paper has passed therethrough.

Figure 8:
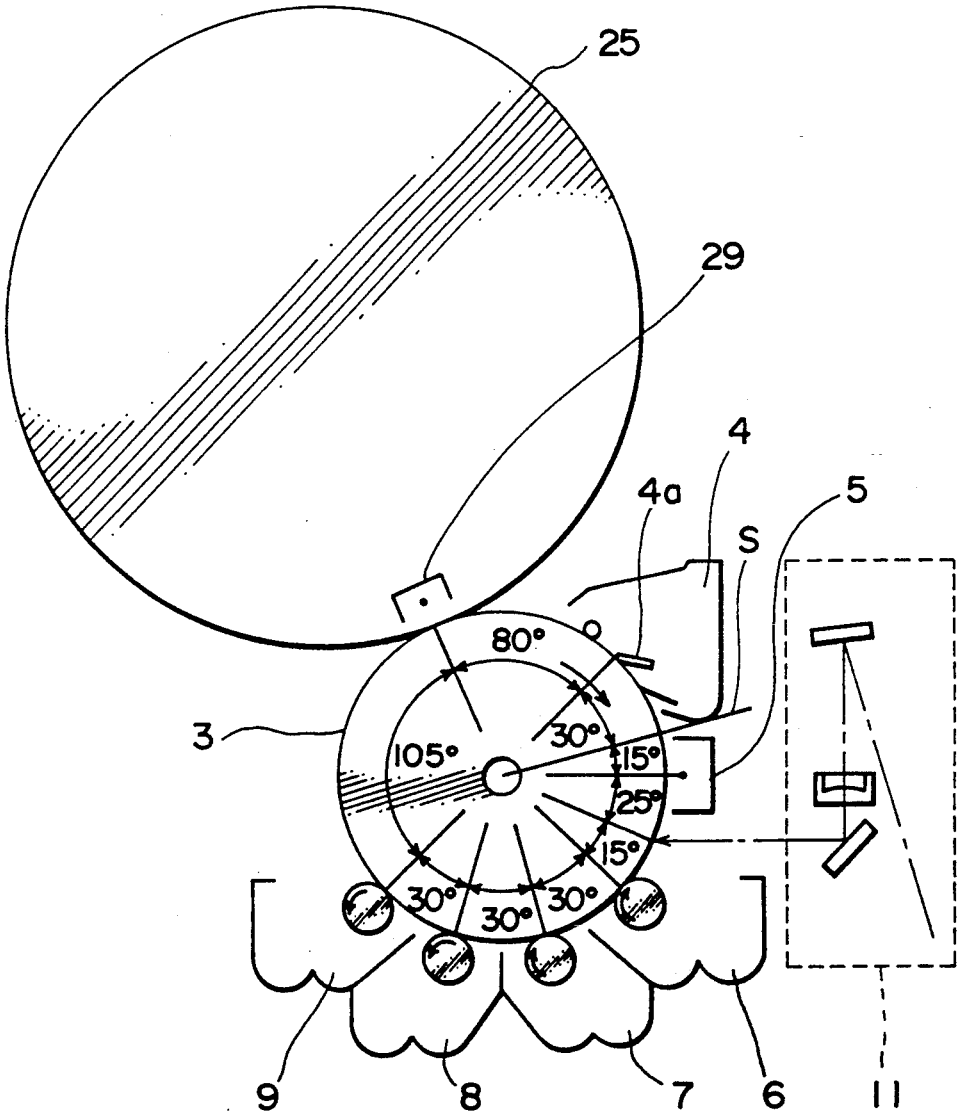
FIG. 8 shows the arrangement of components in a process cartridge shown in FIG. 1.

FIG. 8 shows relative positions of the components in the process cartridge 2 shown in FIG. 1 to the photosensitive drum 3. In FIG. 8, the photosensitive drum 3 is rotated in the clockwise direction, and the angular positions of the components are shown using a position of the finish of the cleaning as a standard position S.

Figure 9:
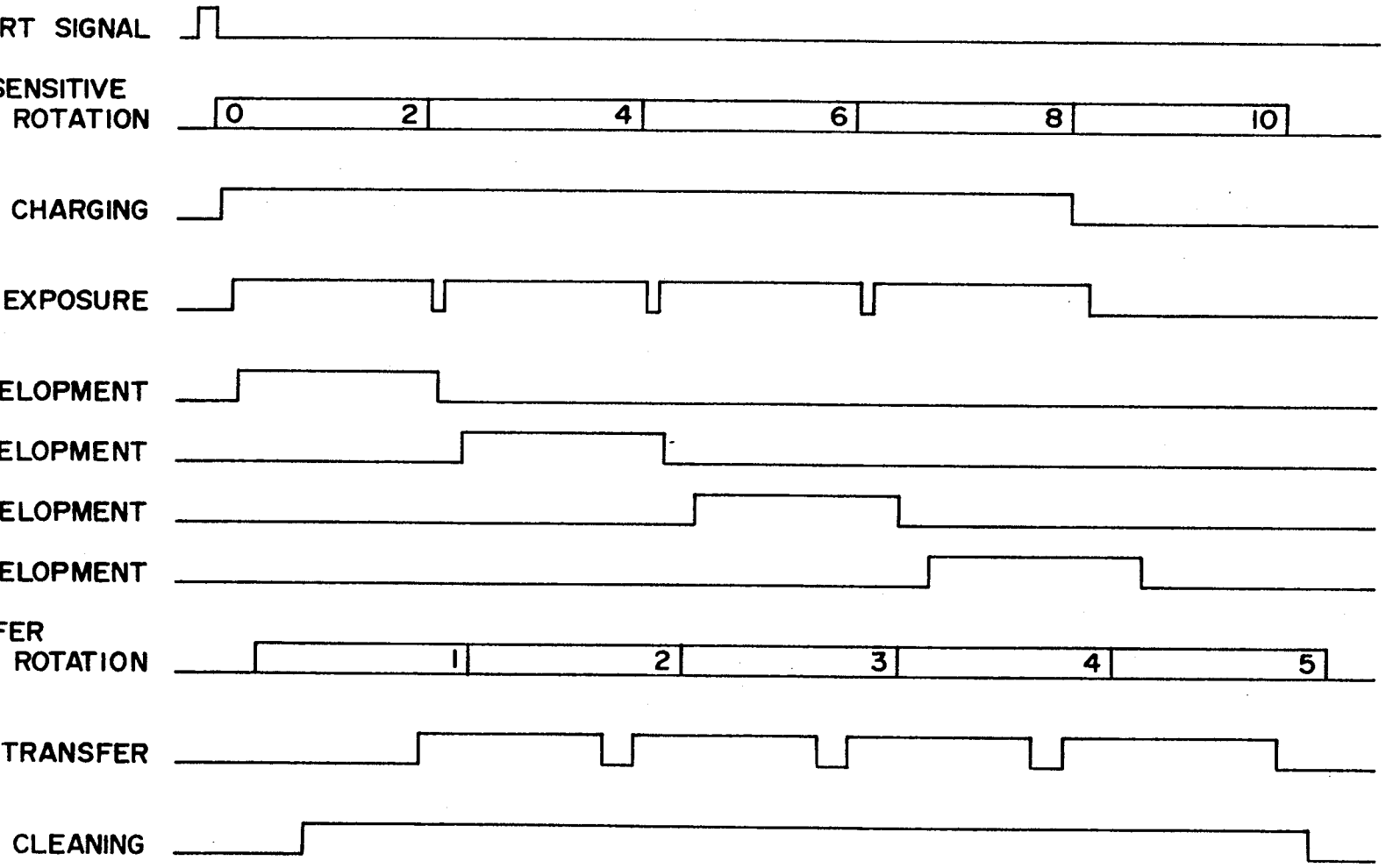
FIG. 9 is a time chart of an image forming process in the color mode of the embodiment shown in FIG. 1.

FIG. 9 is a timing chart of the image formation in the color mode in the embodiment according to the present invention. As shown in FIG. 9, one cycle of the processes of charging, image exposing, toner image forming, transferring and cleaning is completed by the rotation of the photosensitive drum 3 of nine times and the rotation of the transfer drum 25 of five times to form a color image.

An image formation in case that the monochromatic mode is selected will be explained as follows.

In this embodiment, the maximum size of the recording paper in the monochromatic mode can be set as A3 as stated before. In case that A3 size is designated by the recording paper size designating portion 102 and the button for the monochromatic mode in the recording mode selecting portion 103 is pressed, the CPU 100 operates the indicating portion 106 to indicate the monochromatic mode and the recording paper size A3. Thereafter, when the copy button 105 is pressed the copy start signal is supplied to the CPU 100. As a result, the CPU 100 controls the image recording portion 101 in the color image forming apparatus of the present invention along the control program adapted to the monochromatic mode and A3 size fed from the image forming process portion 104 to carry out the monochromatic image forming process.

When the copy button 105 is pressed as like as in the case of the color mode, the photosensitive drum 3 is started to rotate in the direction of arrow in FIG. 8, so that the cleaning and the charging are effected. When the recording papers are fed sheet by sheet from the feed paper cassette 12B, for example, selected by the designation of the recording paper size, and the leading end of the recording paper reaches the timing rollers 17, it is detected by the detecting means and the rotations of the feed rollers 13 and the forward rollers 14 are stopped. The surface of the photosensitive drum 3 which has been cleaned by the cleaning device 4 and charged uniformly by the charging device 5 is subjected to the image exposure of the monochromatic image by the image exposure device 11 to form an electrostatic latent image of dot structure. This electrostatic latent image is passed through the developing devices 6–8 of inoperative state and is subjected to the non-contact reversal development by the developing device 9 containing BK (black color) toner to form a BK toner image on the photosensitive drum 3. The recording paper is fed by the timing rollers 17 so that the leading end of the recording paper reaches the transfer portion just before the leading end of said BK toner image reaches the transfer portion. The transfer drum 25 holds the leading end of the recording paper by using the clamp bar 32*a* shown in FIG. 3 and is started to rotate and brought into contact with the photosensitive drum 3 by the transfer member moving device 28. The recording paper is charged with a polarity opposite to that of the toner by the transfer device 29 which has started discharging, so that the toner image on the photosensitive drum 3 is transferred to the recording paper. Just before the leading end of the recording paper reaches the recording paper separation pawl 45, the leading end of the recording paper is released from the transfer drum 25 by the action of the operation arm 34 and the recording paper is separated from the transfer drum 25 by the operations of the separating device 19 and the recording paper separation pawl 45. Then, the back surface of the recording paper is attracted by the suction conveyer 44, so that the recording paper is fed to the fixing device 20. The photosensitive drum 3 and the transfer drum 25 are rotated more than four times at the uniform peripheral speed while holding the recording paper between the photosensitive drum 3 and the transfer drum 25 until the trailing end of the recording paper has passed through the transfer portion, so that the BK toner image is transferred to the recording paper. The toner image is fixed on the recording paper by the fixing device 20 and the recording paper passed through the fixing device 20 is discharged to the paper receiving tray 22 by the pair of exhaust rollers 21.

When the transfer drum 25 is rotated substantially twice and the trailing end of the recording paper has passed through the transfer portion, the transfer drum 25 is separated from the photosensitive drum 3 by the transfer member moving device 28 and then stopped when the clamp bar 32*a* reaches the start position thereof again. The photosensitive drum 3 is stopped after it has been separated from the transfer drum 25. Next monochromatic image formation can be carried out by repeating the above steps.

Figure 10:
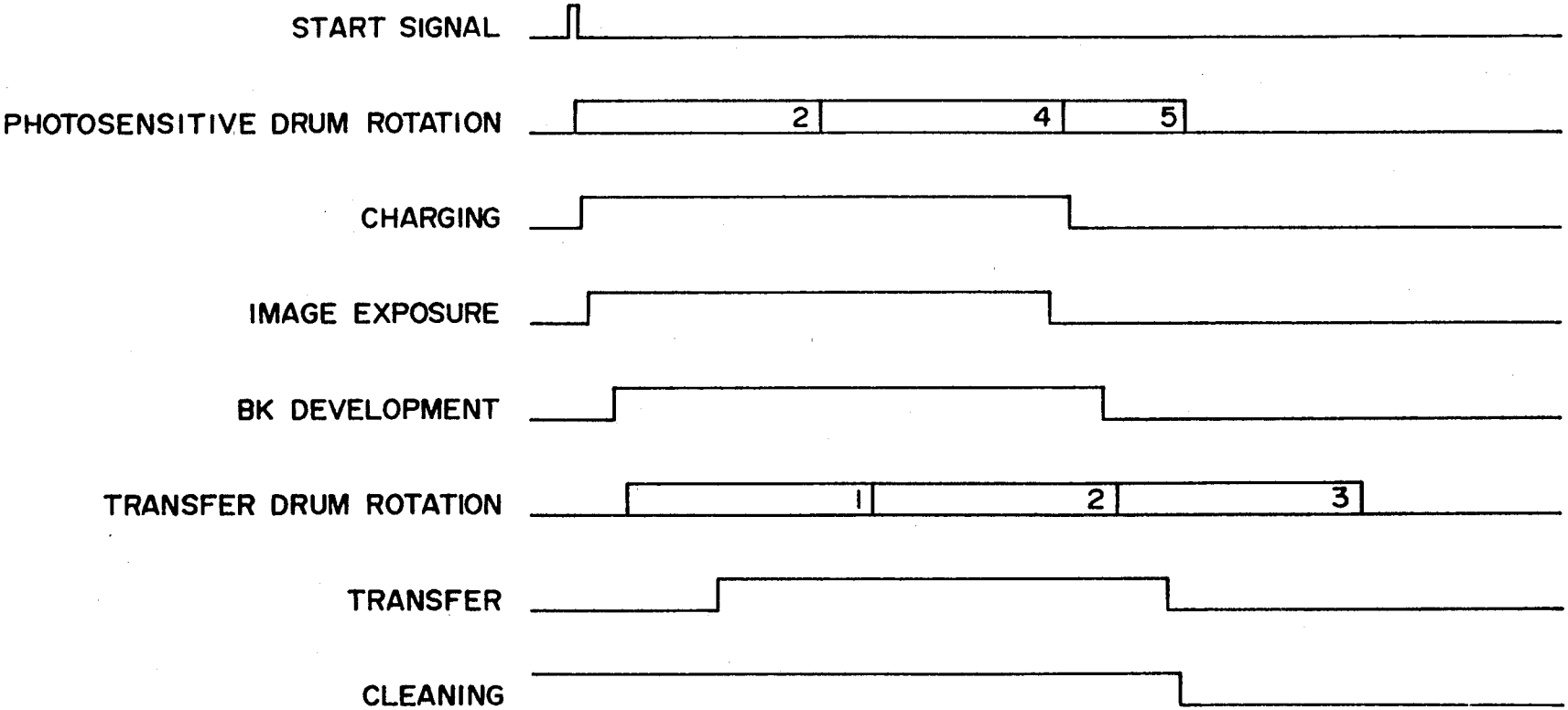
FIG. 10 is a time chart of an image forming process in the monochromataic mode for A3 size of the embodiment shown in FIG. 1.

FIG. 10 shows a timing chart of the image formation in case of said monochromatic mode and the recording paper of A3 size. As shown in FIG. 10, one cycle of the charging, image exposing, toner image forming, transferring and cleaning is completed by the rotation of the photosensitive drum 3 of four times and the rotation of the transfer drum 25 of two times to form a monochromatic image.

Figure 5:
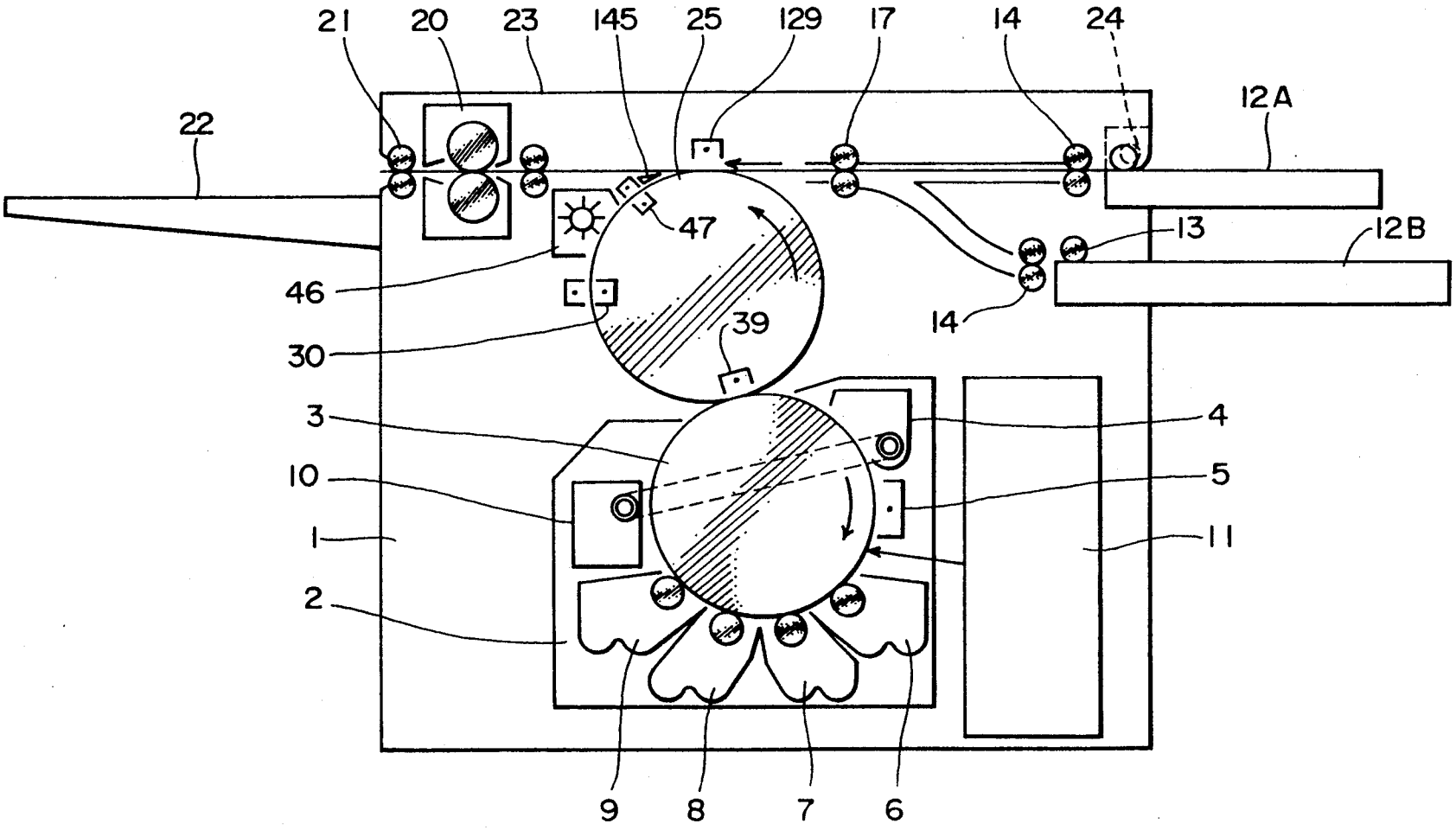
FIG. 5 is a schematic view of a second embodiment according to the present invention.
Figure 6:
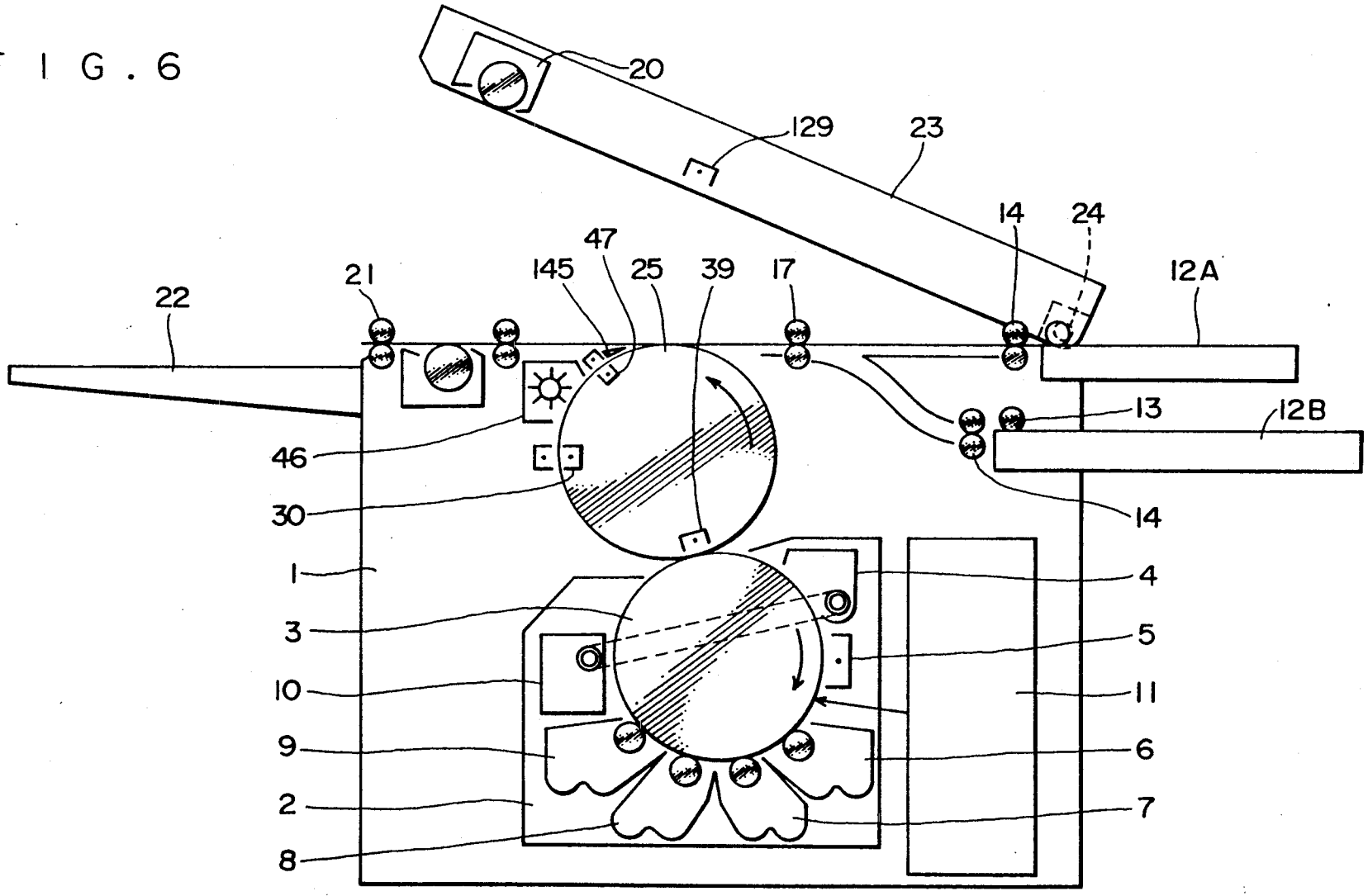
FIG. 6 is a schematic view of the apparatus shown in FIG. 5 with an upper case member being opened.

FIG. 5 is a schematic view of a second embodiment according to the present invention, and FIG. 6 is a schematic view of the apparatus shown in FIG. 5 with the upper case member being opened.

In said second embodiment, toner images on the photosensitive drum 3 are transferred to the transfer drum 25 to superpose on one another and then transferred at a time to the recording paper to form a color image. In this embodiment, the diameter of the photosensitive drum 3 is 100 mm similar to that of the transfer drum 25. Further, if the maximum size of the recording paper in case of color mode is A4, which is limited by the peripheral length of the transfer drum 25, the maximum size of the recording paper in case of monochromatic mode can be set to A3 which is larger than A4 by one rank.

In FIGS. 5 and 6, the same components as those depicted in FIGS. 1 and 2 are assigned to the like reference numerals and the detailed explanations thereof are omitted.

In this embodiment, the recording paper is not wound around the transfer drum 25, so that no clamp means is necessary. However, it is necessary to provide a transfer device 39 for transferring a toner image on the photosensitive drum 3 to the transfer drum 25, a transfer device 129 for transferring the toner image on the transfer drum 25 to the recording paper, a separation device 145 for separating the recording paper and a cleaning device 46 for cleaning the transfer member 25.

In this embodiment, the upper case member 23 can be rotated to open around the hinge portion 24 as in the case shown in FIG. 2. When the upper case member 23 is opened, the transfer drum 3 is urged by a spring (not shown) and separated from the photosensitive drum 3, so that the process cartridge 2 can be withdrawn therefrom or inserted thereinto. When the upper case member 23 is closed against the spring action, the transfer drum 25 is brought into contact with the photosensitive drum 3.

The process of the image formation in this embodiment is carried out by the control of the CPU 100 as like as in the embodiment shown in FIG. 1. In case of the color image formation, the size of the recording paper is limited to the peripheral length of the transfer drum 25. When the copy button 105 is pressed the photosensitive drum 3 and the transfer drum 25 are rotated at the same time. For example, a Y toner image is formed on the photosensitive drum 3 at first as like as in the color image forming apparatus shown in FIG. 1. When the leading end of the Y toner image reaches a portion where the transfer drum 25 is brought into press contact with the photosensitive drum 3 the Y toner image is transferred to the transfer drum 25 by the transfer device 39. Then, the toner image formations and transfers for M toner image, C toner image and BK toner image are effected successibly to form a four-color toner image on the transfer drum 25. The toner image on the transfer drum 25 is transferred by the transfer device 129 to the back surface of the recording paper which is fed by the timing rollers 17 at such a timing that the leading end of the recording paper is in accord with the leading end of the toner image which has reached to the transfer device 129 at the fourth rotation of the transfer drum. The recording paper is then fed, fixed and discharged with the image faced downwards (so-called face down) on the tray 22 by the pair of exhaust rollers 21. After the transfer of the toner image to the recording paper has finished, the transfer drum 25 is cleaned by the cleaning device 46 of operative state in the image forming step, and becomes to the stand-by state for the next image formation.

Figure 11:
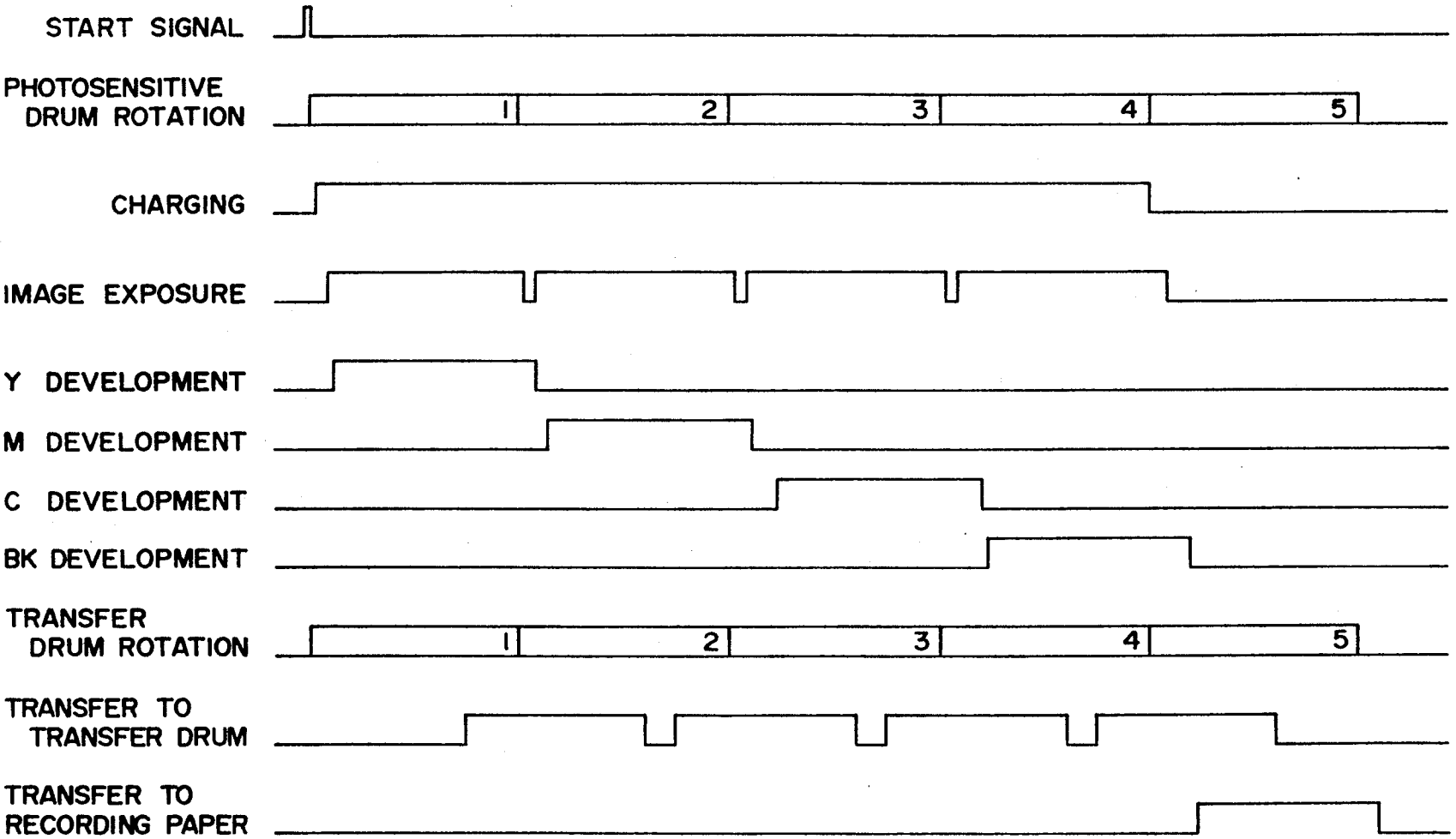
FIG. 11 is a time chart of an image forming process in the color mode of the embodiment shown in FIG. 5.

As shown in the time chart of said image forming process of FIG. 11, the image forming process is completed by the rotations of the photosensitive drum 3 and the transfer drum 25 of five times.

The image formation in the monochromatic mode in this embodiment can be carried out by the control of the CPU 100 shown in FIG. 7 as like as in said first embodiment. Specifically, after an image forming mode and a recording paper size have been designated the copy button 105 is pressed to start the image formation. Then, an image exposure according to the monochromatic image data is effected by the image exposure device on the photosensitive drum 3 which has been cleaned and charged uniformly to form an electrostatic latent image.

The electrostatic latent image is passed through the developing devices 6–8 of inoperative state having the Y toner, M toner and C toner, respectively, and developed by the developing device 9 containing the BK toner to form a BK toner image. This BK toner image is transferred to the transfer drum 25 by the transfer device 39 at the press contact portion of the photosensitive drum 3 to the transfer drum 25. The transferred BK toner image is then transferred by the transfer device 129 to the recording paper fed by the timing rollers 17. After the transfer has finished, the surface of the transfer drum 25 is cleaned by the cleaning device 46 and subjected to the following steps of transfer the toner image from the photosensitive drum 3 to the transfer drum 25 and from the transfer drum 25 to the recording paper while rotating the transfer drum 25. The recording paper to which the toner image has been transferred is separated from the transfer drum 25 by the separation device 145, fed to the fixing device 20 for fixing, and discharged to the tray 22 by the pair of exhaust rollers 21.

Figure 12:
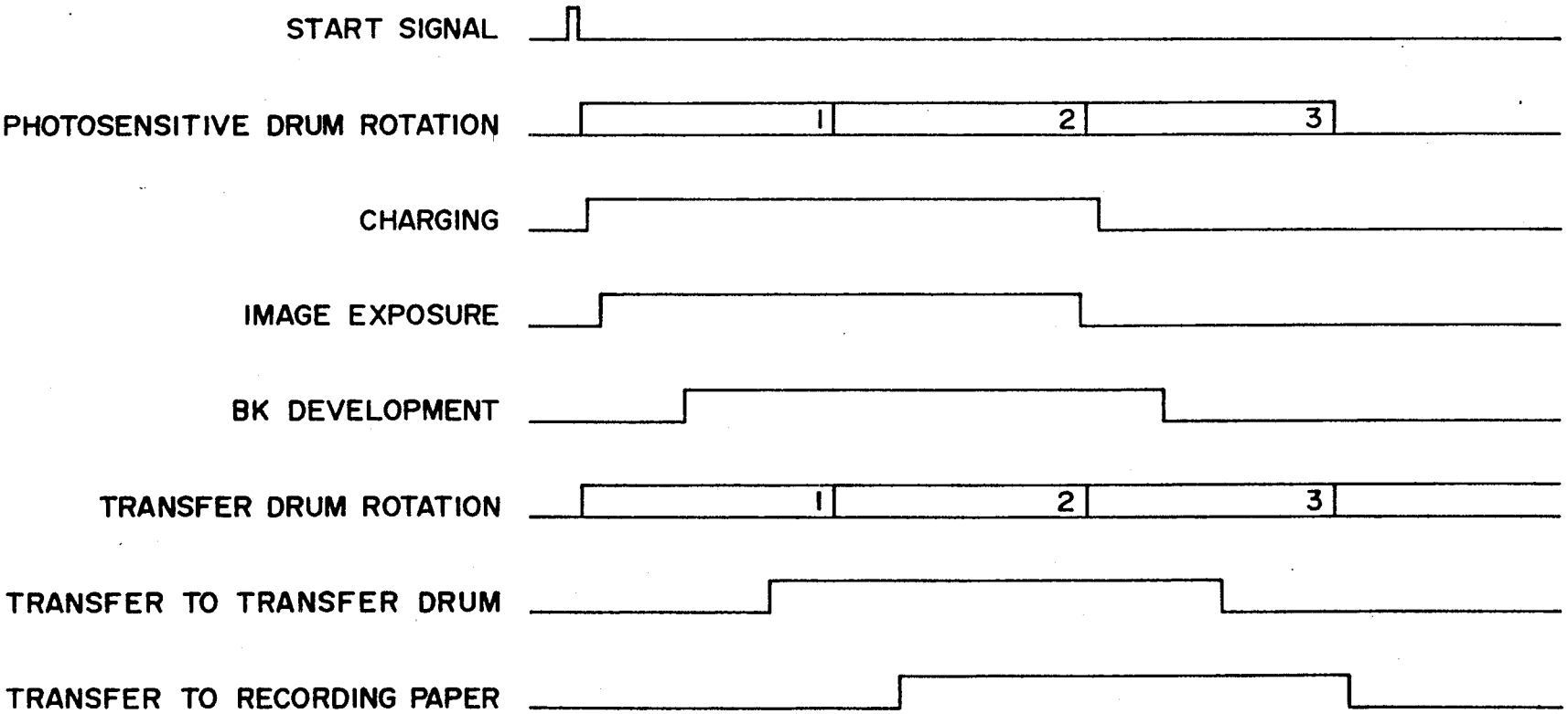
FIG. 12 is a time chart of an image forming process in the monochromatic mode for A3 size of the embodiment shown in FIG. 5.

FIG. 12 shows a time chart of the image forming process in the monochromatic mode to which A3 size is designated as the recording paper size. As shown in FIG. 12, the image recording is completed by the rotations of the photosensitive drum 3 and the transfer drum 25 of three times.

In this embodiment, the image recorded transfer papers are discharged in the state of the face down, so that the recording papers can be discharged in order of pages, thereby facilitating the following handling.

EFFECT OF THE INVENTION

According to the present inventions, the size of the color image recording is limited by the length of the transfer member, however the size of the monochromatic image recording can be made larger than the above.

What is claimed is:

1. A color image forming apparatus comprising:

a rotatable image retainer for forming a monochromatic toner image thereon, said rotatable image retainer facing an image retainer charging means, an exposure means, and a developing means arranged at respective spaced apart positions;

a rotatable transfer member facing said rotatable image retainer and having a predetermined circumferential length;

transfer means for transferring said monochromatic toner image from said image retainer to said transfer member whenever said monochromatic toner image is formed on said image retainer; and control means for selecting either a monochromatic mode for forming a monochromatic toner image or a multicolor mode for forming a multicolor toner image composed of a plurality of monochromatic toner images and for limiting the maximum length of a multicolor toner image to be formed on said transfer member to said circumferential length of said transfer member irrespective of the circumferential length of said image retainer when said multicolor mode is selected, the maximum length of a monochromatic toner image to be formed on said image retainer and transferred to said transfer member not being limited by said circumferential length of said image retainer and transfer member when said monochromatic mode is selected.

2. The apparatus of claim 1 wherein said transfer member maintains a transfer sheet so that said monochromatic toner image is transferred from said image retainer onto said transfer sheet.

3. The apparatus of claim 2 wherein every time said monochromatic toner image is formed on said image retainer, each of said plurality of monochromatic toner images is transferred on said transfer sheet so that said multicolor toner image is obtained by superposing said plurality of monochromatic toner images on said transfer sheet.

4. The apparatus of claim 1 further comprising a first unit having said transfer member and a second unit having said image retainer, wherein said first unit is capable of being opened from said second unit.

5. The apparatus of claim 1 wherein said rotatable image retainer is a photoreceptor.

6. The apparatus of claim 1 wherein said transfer member is drum-shaped.

* * * * *